US006538217B1

(12) United States Patent
Eriksen et al.

(10) Patent No.: US 6,538,217 B1
(45) Date of Patent: Mar. 25, 2003

(54) MANUALLY OPERABLE SUITABLE CONTROL UNIT FOR A BOAT

(75) Inventors: Tore Eriksen, Skjeberg (NO); Ronny Skauen, Gressvik (NO)

(73) Assignee: Sleipner Motor AS, Fredrikstad (NO)

( * ) Notice: Subject to any disclaimer, the term of this patent is extended or adjusted under 35 U.S.C. 154(b) by 133 days.

(21) Appl. No.: 09/679,803

(22) Filed: Oct. 5, 2000

(51) Int. Cl.[7] ..... H01H 9/06; H01H 35/00; B63H 21/21

(52) U.S. Cl. ..... 200/5 R; 200/52 R; 200/61.58 R; 114/144 RE; 114/382; 440/84; 440/113; 180/333

(58) Field of Search ..... 200/52 R, 5 R–5 EB, 200/553–574, 61.58 R, 61.85; 180/333; D13/174; 440/84–87, 113; 114/144 RE, 151, 382

(56) References Cited

U.S. PATENT DOCUMENTS 3,919,510 A * 11/1975 Barnes ..... 200/61.88
4,180,713 A * 12/1979 Gomzales ..... 200/52 R
4,701,629 A * 10/1987 Citroen ..... 307/10.1
5,446,253 A * 8/1995 Oshgan ..... 200/556
5,680,927 A * 10/1997 Thornton ..... 200/565
6,142,841 A 11/2000 Alexander, Jr. et al. ..... 440/38
6,273,771 B1 * 8/2001 Buckley et al. ..... 440/84
6,280,269 B1 * 8/2001 Gaynor ..... 440/84

* cited by examiner

*Primary Examiner*—J. R. Scott
(74) *Attorney, Agent, or Firm*—Barry R. Lipsitz

(57) ABSTRACT

A thuster control unit which in general comprises a base plate 100, a switch panel 200 mounted on said base plate, and a boat shaped, or navicular, control knob 500 mounted on the base plate such that it is displaceable over the switch panel. The panel is equipped with switches, such as embedded switches, for controlling bow and stem thrusters, and/or any other propulsion unit. The control knob is equipped actuator pegs 425, biased downwards, each thus transmitting a force to the switch panel. In a non-actuated state, the navicular control knob remains in a neutral position in which position no one of the embedded boat manoeuvring control switches are operated. The forward and aft actuator pegs thus activate the forward and aft boat manoeuvring control switches respectively in a manner corresponding with a selective displacement of the navicular control knob. The boat shaped control knob provides a novel, efficient and reliable means for a combined control of any boat propulsion system.

44 Claims, 17 Drawing Sheets

MANUALLY OPERABLE SUITABLE CONTROL UNIT FOR A BOAT

BACKGROUND OF THE INVENTION

1. Field of the Invention

This invention relates to the field of electrical switches. The invention relates to a device for operating multiple electrical switches, and more specifically to a device for operating electrical switches controlling marine power units, such as bow and stern thrusters and other propulsion units for boats.

2. Description of the Related Art

Bow and stern thrusters have for several years been used as a means for maneuvering large and small watercraft in situations where the watercraft speed is too low to enable adequate rudder control. Particularly in connection with docking and setting off, or other low speed operations, have such thrusters proven very useful.

Bow and stern thrusters may be electrically or hydraulically driven, and have traditionally been controlled by means of various joystick configurations mounted on the boat control panel, and operated by the person actually steering the boat.

More recently, such bow thrusters and also stern thrusters have become more commonplace on smaller vessels, such as pleasure boats down to approximately 20 feet. As public marinas are becoming more crowded, more and more pleasure boat owners are relying on lateral thrusters to avoid damages and accidents in connection with docking and setting off.

As mentioned, thrusters are commonly controlled and operated by means of various joystick arrangements. One configuration as shown in FIG. 2*b* consists of a dual joy stick unit 20; one joy stick 22 providing lateral bow control and one joy stick 24 controlling the stern thruster. Another configuration as shown in FIG. 2*a* employs a single joystick 26 with a switch 28 mounted on top of the joystick 26. The operator may then switch back and forth between forward and aft thrusters.

Common problems with the known existing joystick arrangements are that they may be awkward to operate and not configured entirely logically in regards the actual resulting boat motion. Existing configurations and arrangements may be particularly difficult to operate for the often little experienced pleasure boat owner.

In situations involving for example strong winds, heavy waves or swell, poor visibility, darkness; particularly the lesser experienced pleasure boat owner is prone to making mistakes in operating the thruster, mistakes which close to quayside, shore or other boats may cause substantial damage and lead to hazardous scenarios.

It is therefore a long felt need for a boat manoeuvring control unit which is easy and logical to use even for the inexperienced boater, has a shape and function which is fail safe and "fool proof" even in the most adverse conditions, and is technically reliable.

The present invention solves the above need, in that it provides a novel means for controlling multiple electrical switches, such as marine boat manoeuvring control switches. It furthermore alleviates the need for multiple joysticks in order to control the thrusters. The boat manoeuvring control unit in accordance with the invention is based on field proved technology, but has a shape and function which is fail safe and "fool proof" even in the most adverse conditions, is easy and logical to use even for the inexperienced boater and is technically reliable.

BRIEF SUMMARY OF THE INVENTION

These and other objects and features of the invention are provided by a control unit which comprises a boat shaped, or navicular, control knob mounted over a switch panel affixed to a base plate. The boat shape is essential, in that the shape and function of this knob is logical, fail safe and "fool proof" even in the most adverse conditions, and is easy to use even for the inexperienced boater.

The base plate lower housing is of a standard size and fits standard control panels. The switch panel has a number of boat manoeuvring control switches, either micro switches or switches embedded in the panel, below a sealing film.

The navicular control knob is fastened to a pair of guide elements riding on each end of a pin which extends through a plug mounted on the base plate. The control knob is thus movable in a horizontal plane over the switch panel.

More specifically, the boat manoeuvring control unit comprises:

- a base plate having a socket, a lower housing, and attachment means;
- a switch panel mounted on the base plate, where the switch panel has a plug receiving aperture, a number of on/off switches, and a number of control switch means; and
- a boat shaped, or navicular, control knob mounted on the base plate and being displaceable over the panel, and where the control knob has a plurality of engagement means.

Furthermore, the control knob is mounted on the base plate by means of:

- a plug, having a longitudinal bore for slidably receiving a coil spring, and where the plug lower structure extends through the aperture and is mounted in the socket; and
- a pair of forward and aft guide elements mounted on the outer ends of forward and aft plug pins and engaging the engaging means respectively.

As an option, the coil spring may be guided by means of a guide pin, coaxially located within the spring.

As an option, two separate plug springs could be employed, but it has been found advantageous to have only one plug spring extending through the plug bore. One plug spring facilitates an easier transverse movement and contributes in a favourable manner to keeping one knob end stationary, when the other is being moved. Such movement of a first control knob end will compress the plug spring axially and thus increase the pressure of the plug pin at the second end, which in turn applies a pressure towards its associated guide element; contributing to keeping the second end in a stationary position.

Each of the guide elements carry an actuator peg, generally vertically oriented. A spring biases the peg in downward direction, such that the peg is held in a position proximal to the panel. The control knob may be horizontally aligned with the switch panel by means of a number of stabilising knobs which are disposed symmetrically along the control knob lower edge, being proximal with the said panel.

The control knob and guide element assembly is movably attached to the plug by means of forward and aft plug pins being longitudinally aligned with said plug and where the plug pins have outer ends each being movably received into respective ones of forward and aft guide element cavities, and the plug pins have inner bores for receiving opposite ends of the coil spring and optionally the guide pin. The plug pins, optional guide pin and spring are slidably disposed in the plug longitudinal bore.

In a non-actuated state, the navicular control knob remains in a neutral position in which position no one of the control switches are operated.

When the control knob is selectively and manually moved in a horizontal plane, the forward and aft actuator pegs are also moved to selective locations over or near the afore mentioned control switches. The peg downward acting forces activate the switches correspondingly by depression or other form of impact.

Due to certain geometric features of the guide element, plug and pins, the control knob may selectively be displaced about either end while the other end remains at rest, the knob may be rotated, and the knob automatically returns to a neutral position released.

Other preferred embodiments are described by the accompanying independent claims.

By means of the invented control unit, any boat propulsion unit, such as bow and stern thrusters, may be controlled by a method to be described in the detailed description.

BRIEF DESCRIPTION OF THE DRAWINGS

FIG. 2*a* showing a conventional thruster joystick comprising a toggle switch for alternating between bow and stern thrusters, and FIG. 2*b* showing a unit comprising two separate joysticks, one for the bow—and one for the stern thruster.

FIG. 5*a* is a rear view, showing a control knob vertical axis ($Z_2$).

FIG. 5*b* is a side view, also showing said vertical axis ($Z_2$).

FIG. 5*c* is a perspective drawing from below, showing alignment and locking features inside the control knob.

FIG. 5*d* is a plan bottom view, also showing alignment and locking features.

FIG. 6*a* is a perspective drawing from below.

FIG. 6*b* is a front view, showing a guide element vertical axis ($Z_1$) and with a section line III—III in the horizontal plane.FIG. 6*c* is a plan top view, also showing said vertical axis ($Z_1$).

FIG. 10: neutral; no motion.

FIG. 11: forward part towards left hand side; bow motion towards port side.

FIG. 12: forward part towards right hand side; bow motion towards starboard side.

FIG. 13: aft part towards left hand side; stern motion towards port.

FIG. 14: aft part towards right hand side; stem motion towards starboard.

FIG. 15: forward part towards left hand side and aft part towards right hand side; bow motion towards port and stem motion towards starboard.

FIG. 16: forward part towards right and aft part towards left; bow motion towards starboard and stern motion towards port.

FIG. 17: sideways towards left; simultaneous bow and stern motion towards port.

FIG. 18: sideways towards right; simultaneous bow and stem motion towards starboard.

DETAILED DESCRIPTION OF THE INVENTION

Figure 1:
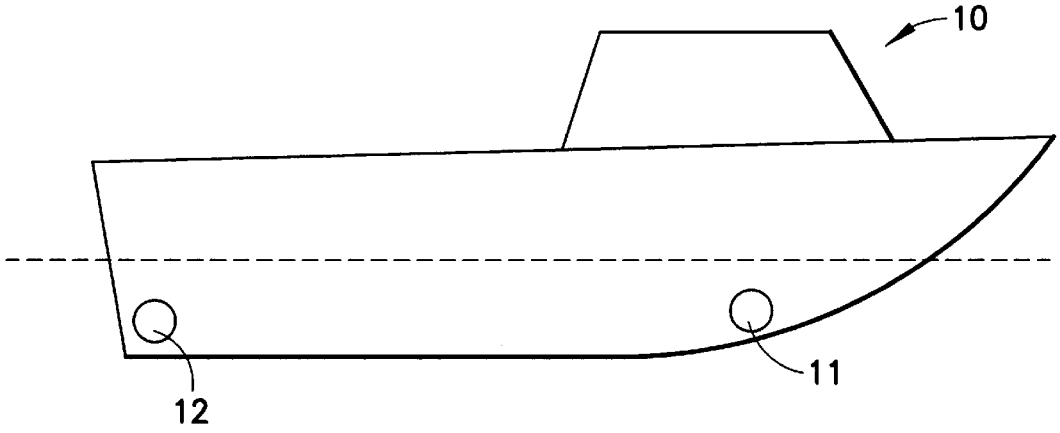
FIG. 1 is a schematic side view of a boat equipped with bow and stern thrusters.
Figure 2A:
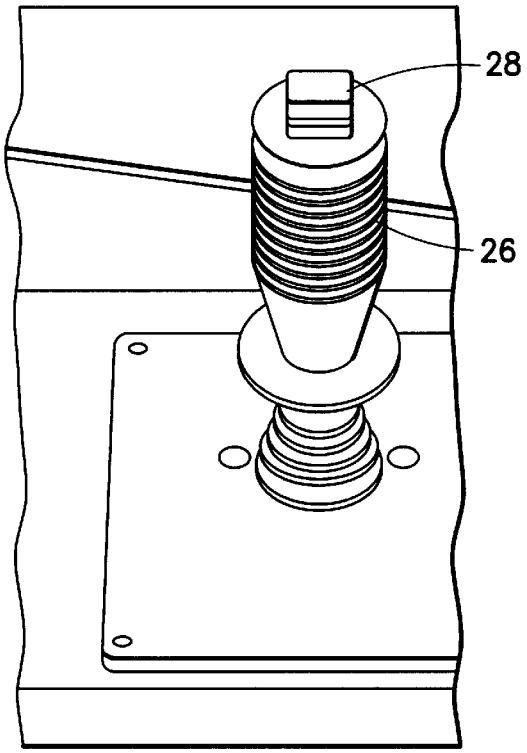
FIG.2a PRIOR ART
FIGS. 2*a* and 2*b* illustrate two types of prior art control units.
Figure 2B:
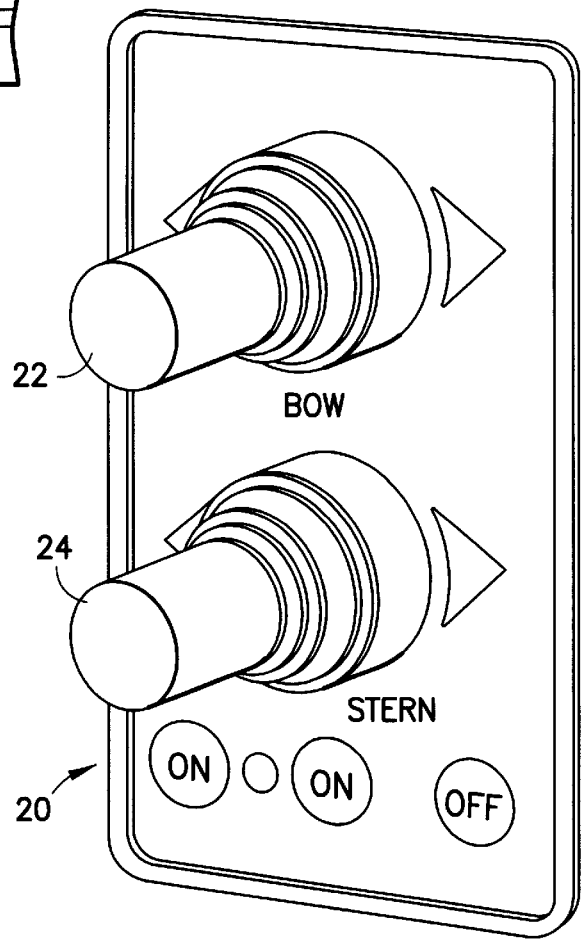
FIG.2b PRIOR ART
Figure 3A:
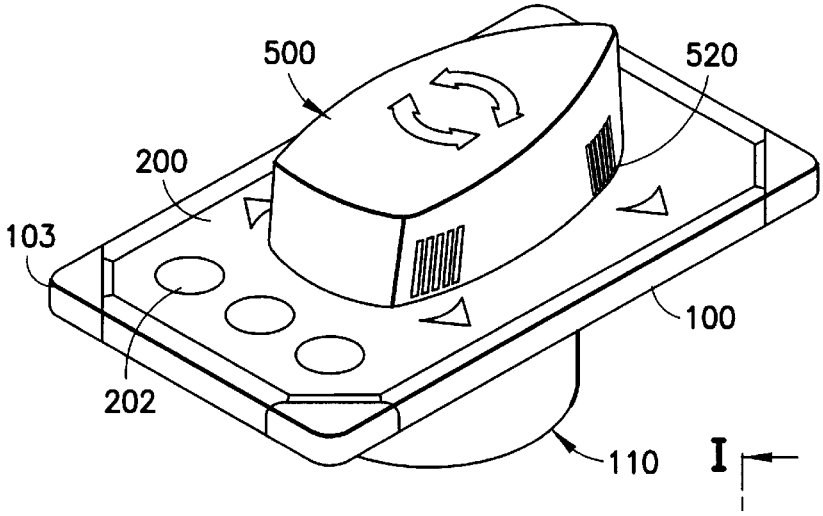
FIG. 3*a* is a perspective drawing of the boat manoeuvring control unit according to an embodiment of the present invention.
Figure 3B:
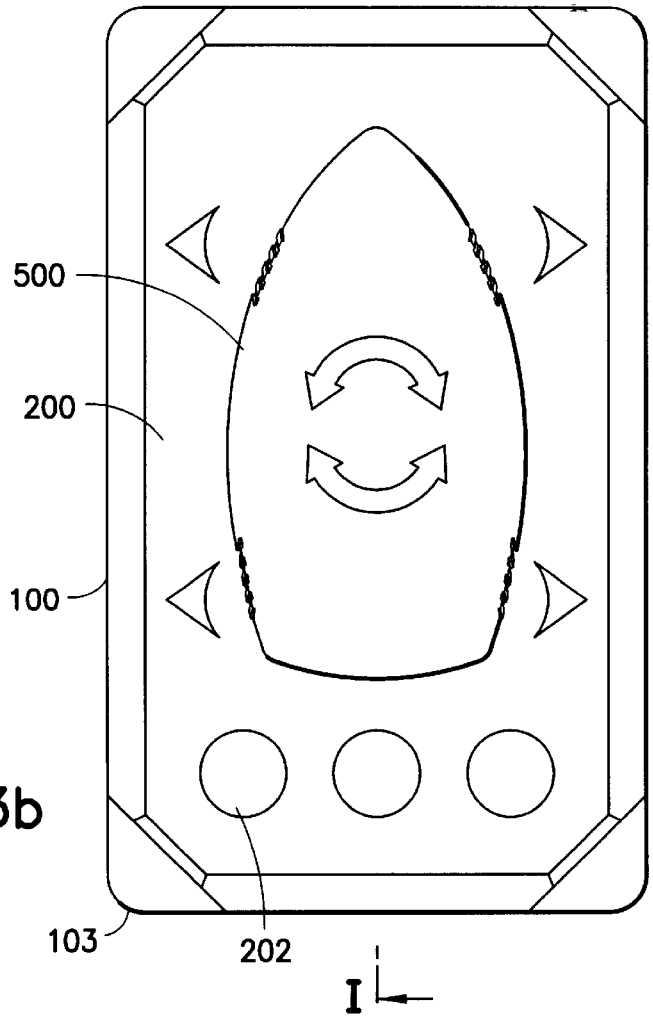
FIG. 3*b* is plan top view of the boat manoeuvring control unit of FIG. 3*a*, with a section line I—I in the vertical plane.
Figure 4A:
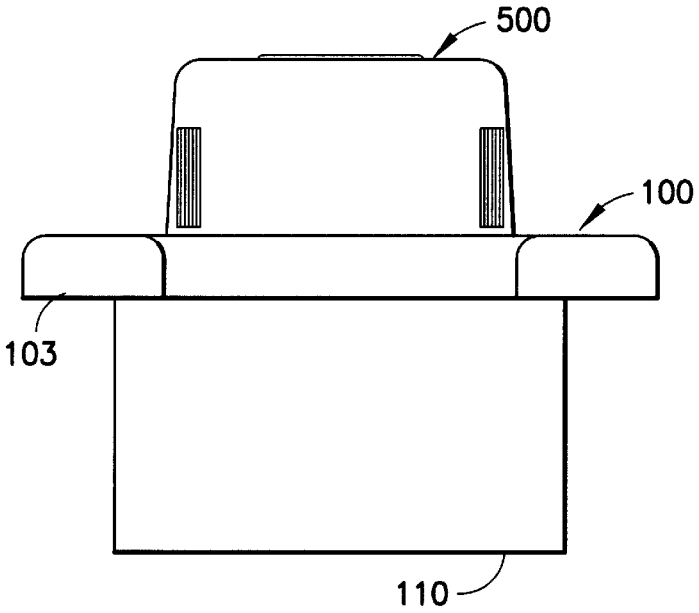
FIG. 4*a* is a rear view of the boat manoeuvring control unit of FIG. 3*a*.
Figure 4B:
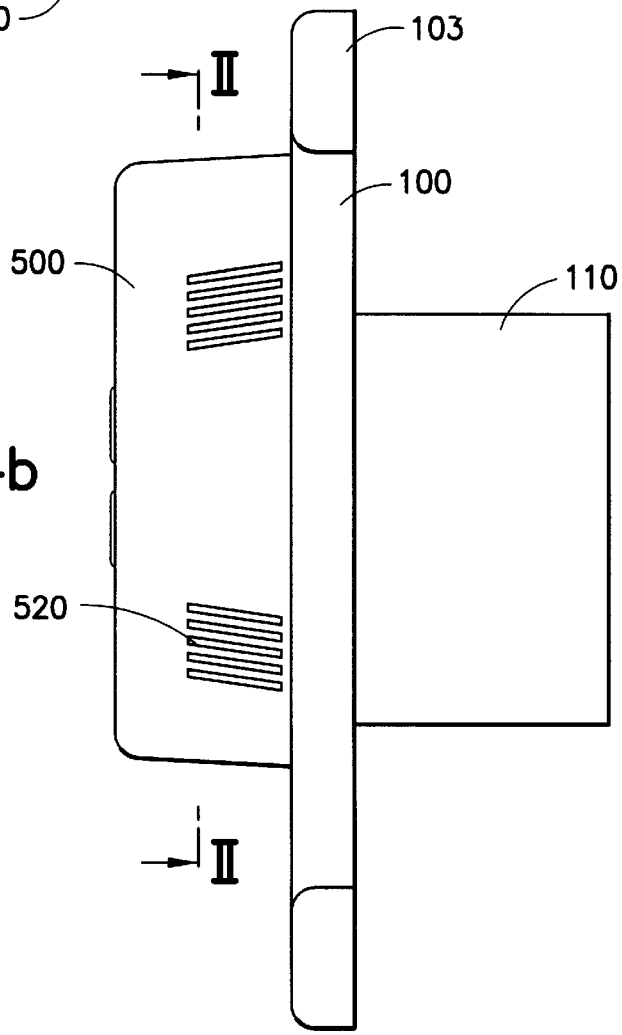
FIG 4*b* is a side view of the boat manoeuvring control unit of FIG. 3*a*, with a section line II—II in the horizontal plane.
Figure 5A:
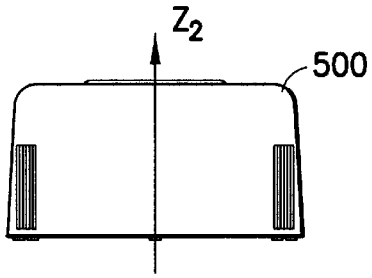
FIGS. 5*a*–5*d* shows the navicular control knob of the control unit according to an embodiment of the present invention, where.
Figure 5B:
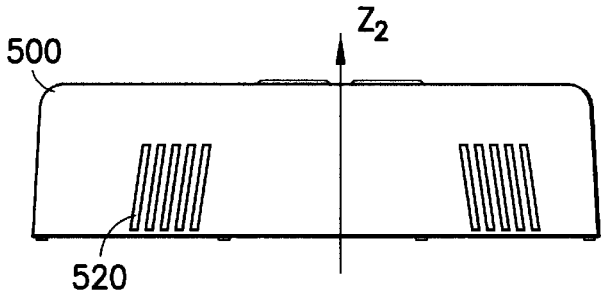
Figure 5C:
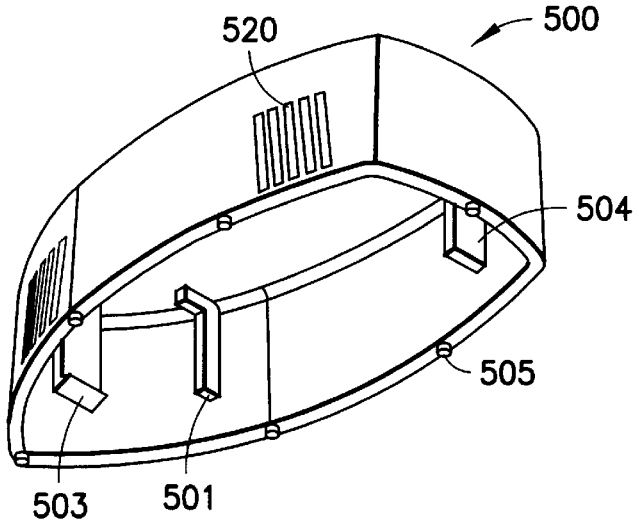
Figure 5D:
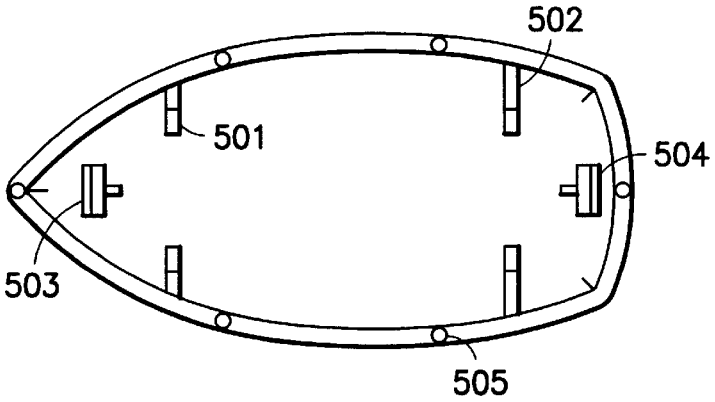
Figure 6A:
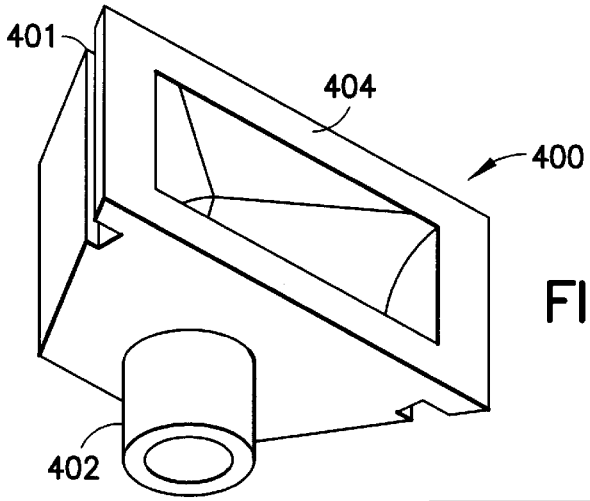
FIGS. 6*a*–6*c* shows the guide element according to an embodiment of the present invention, where.
Figure 6B:
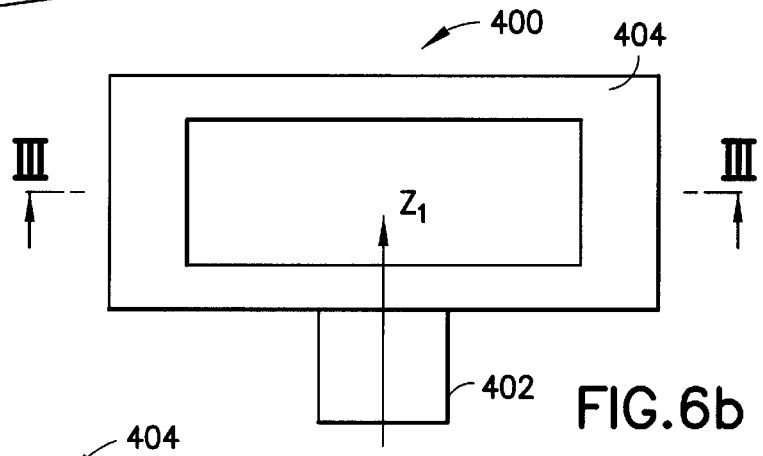
Figure 6C:
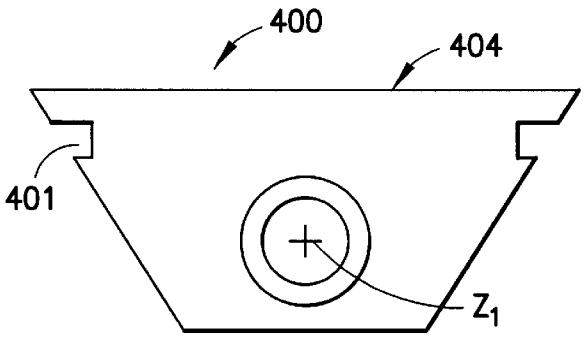
Figure 7:
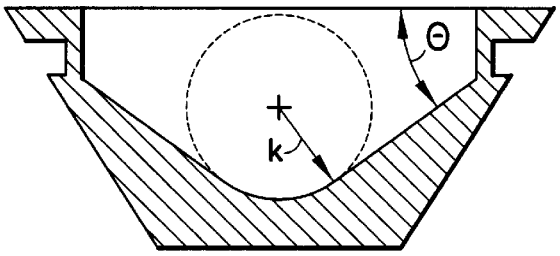
FIG. 7 is a plan view along section III—III, as identified in FIG. 6*b*, showing a guide element cavity radius (k) and tangential angle (θ).
Figure 8:
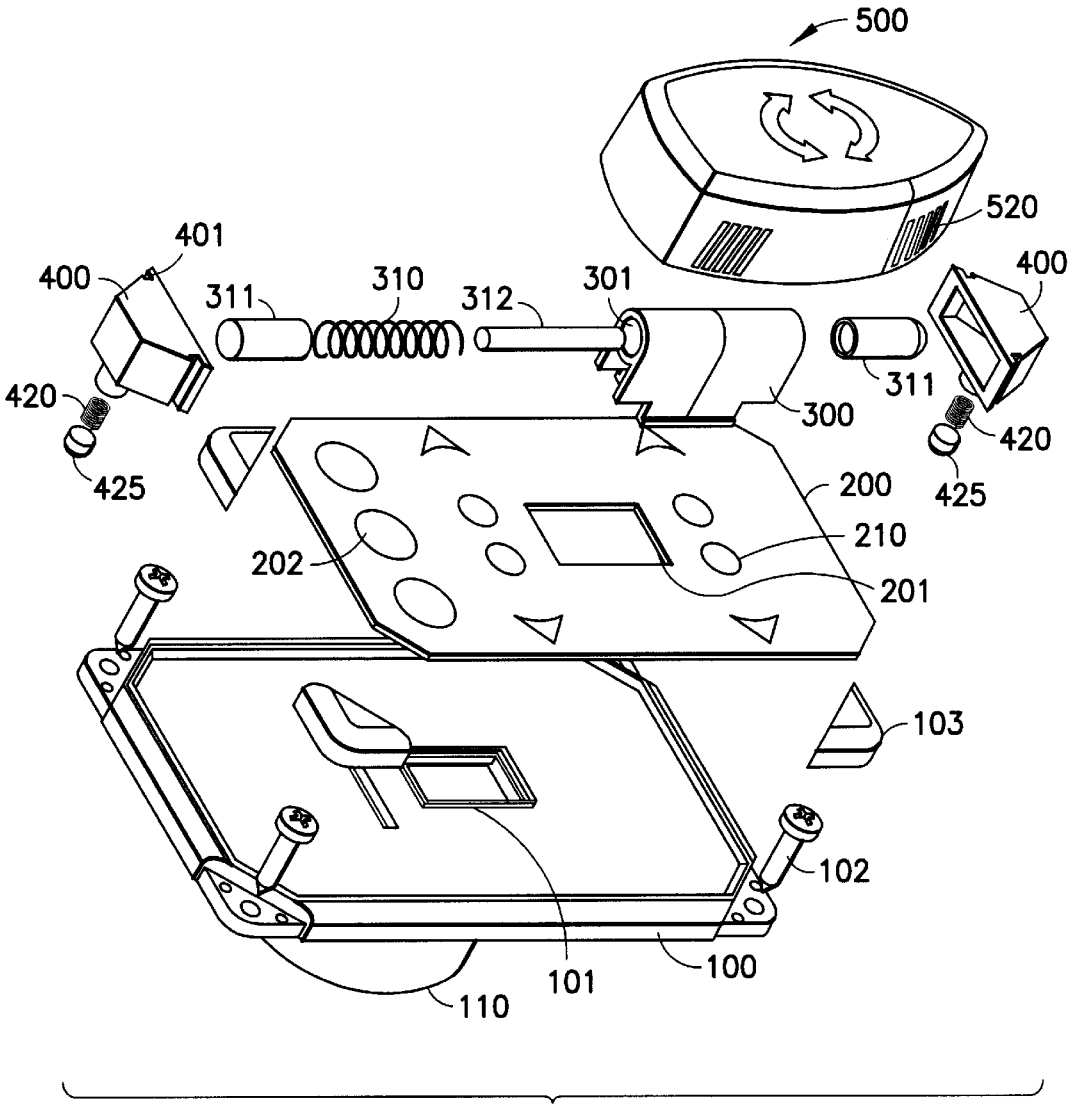
FIG. 8 is an exploded view of the control unit according to an embodiment of the present invention.
Figure 9:
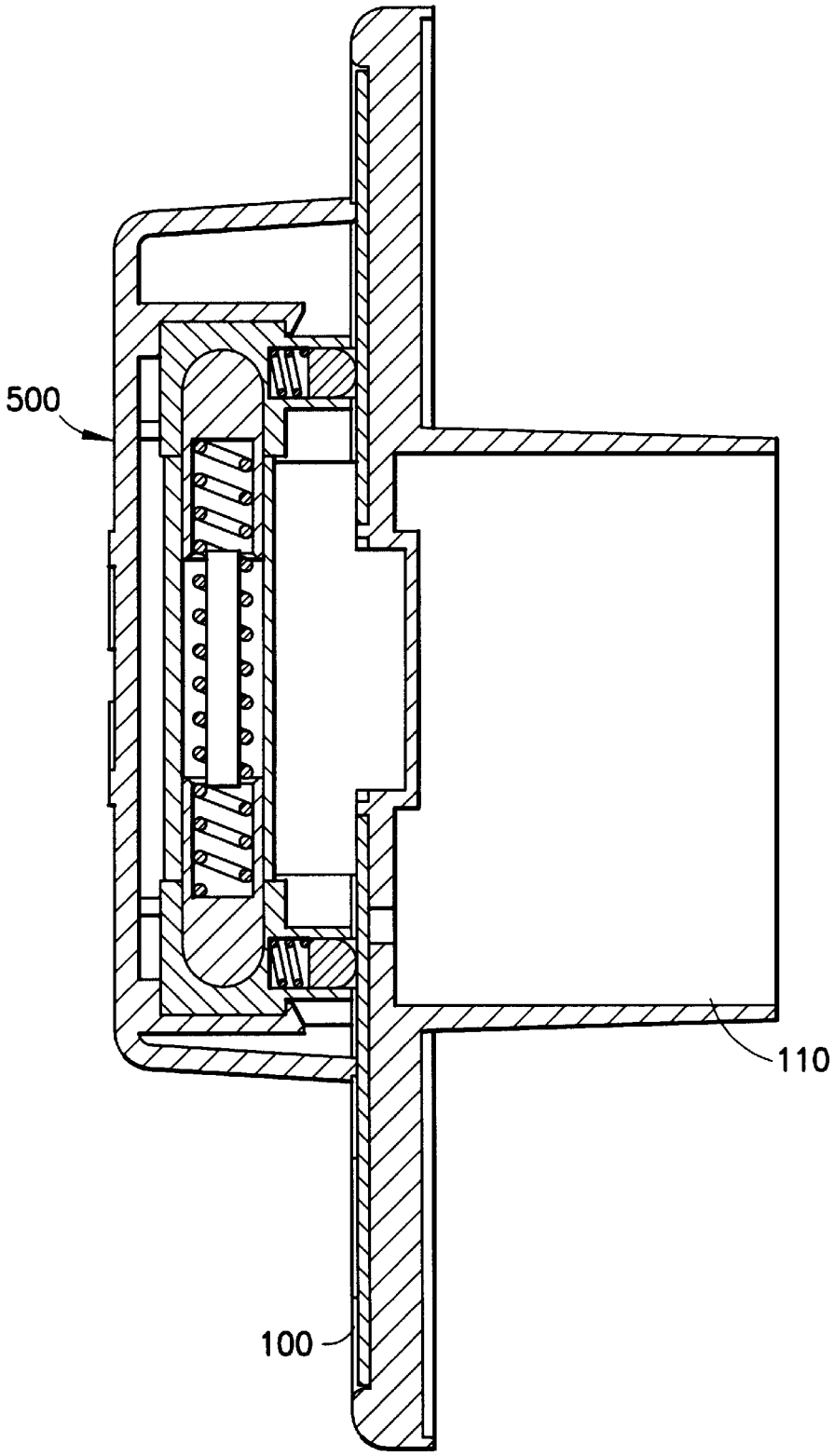
FIG. 9 is a cross sectional view along the section line I—I, as identified in FIG. 3*b*.
Figure 10:
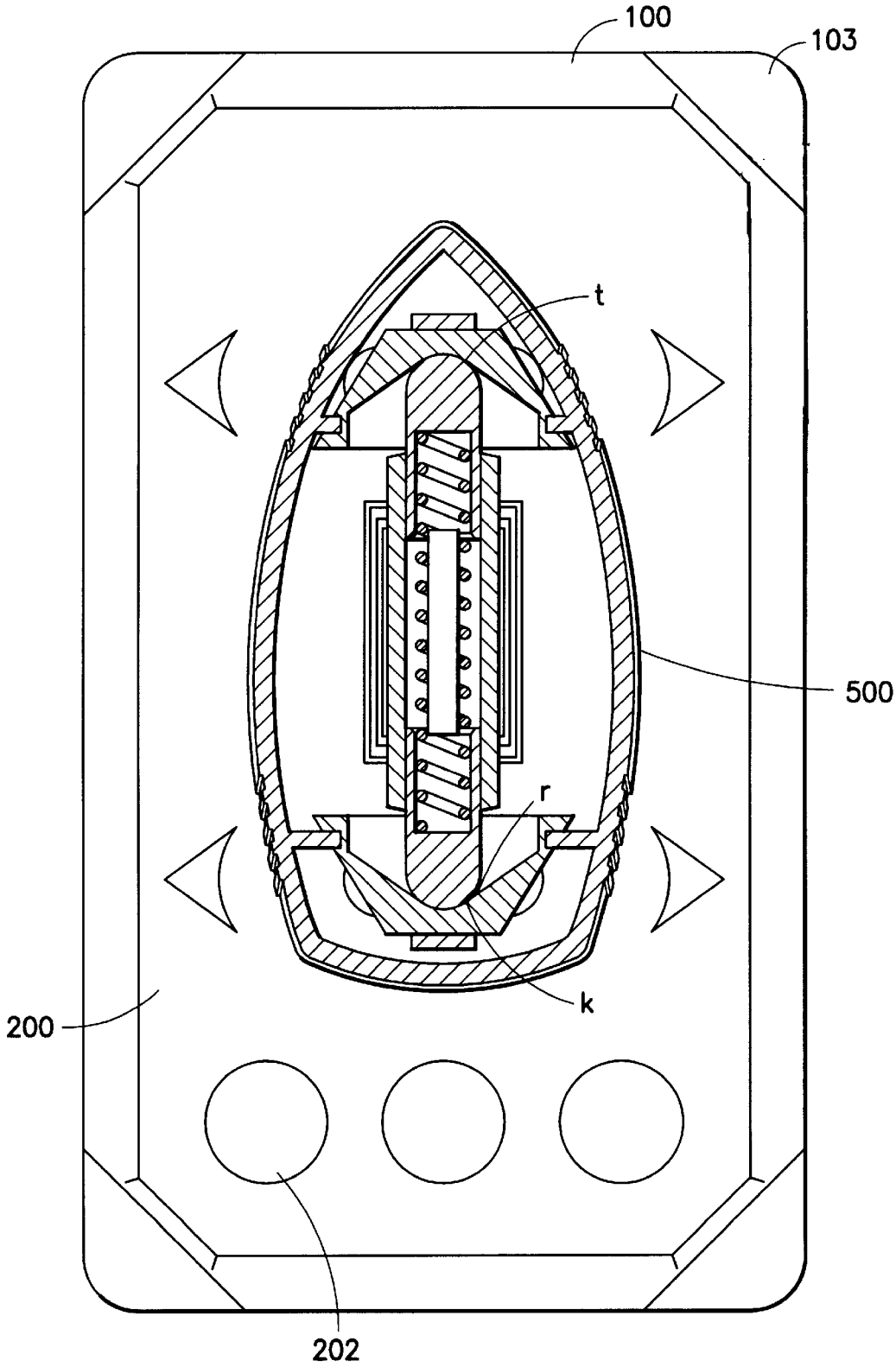
FIGS. 10 through 18 are a plan section views along the section line II—II, as identified in FIG. 4*b*, where the control unit is shown in the following positions, inducing the following respective boat motions.
Figure 11:
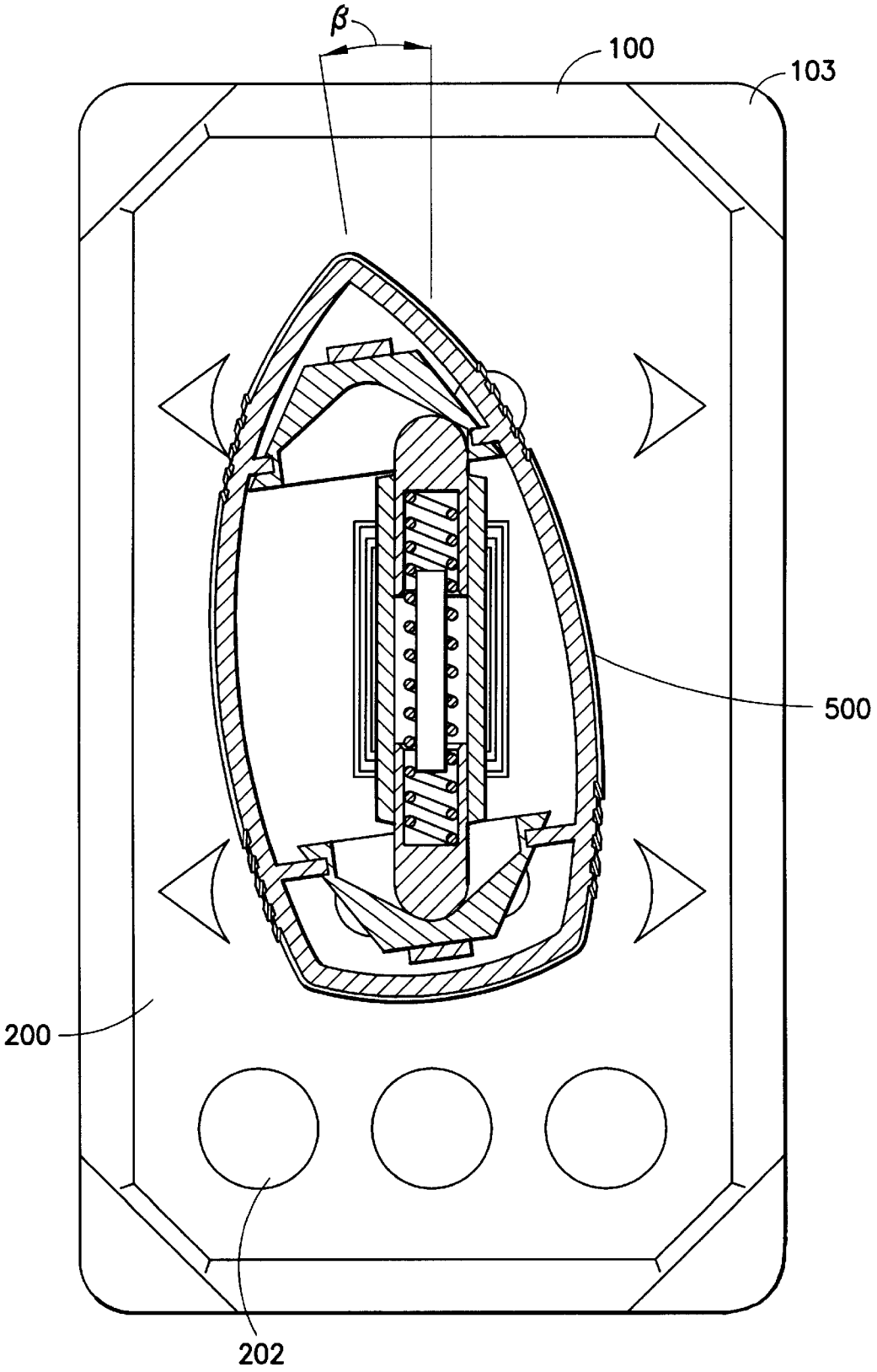
Figure 12:
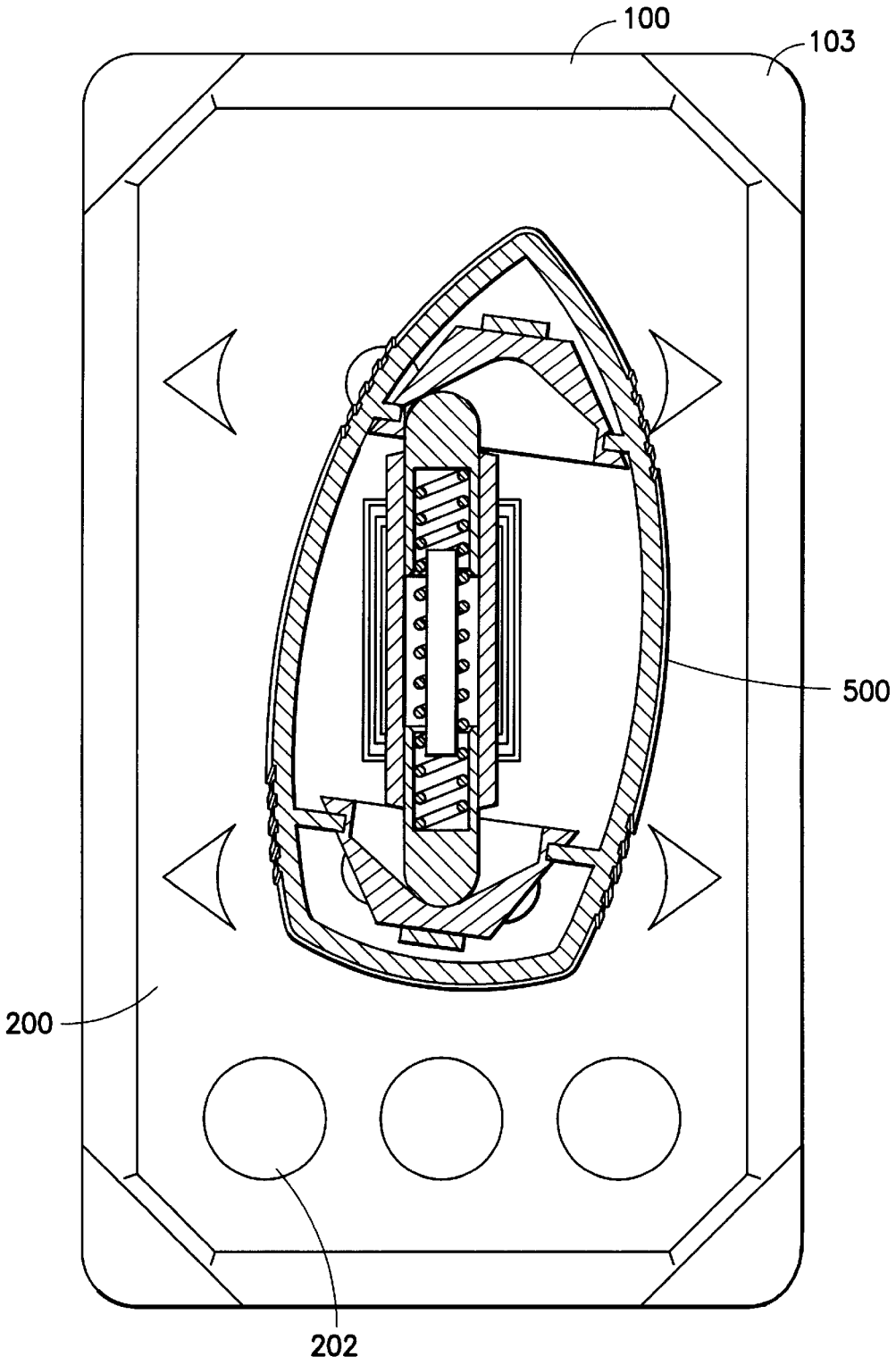
Figure 13:
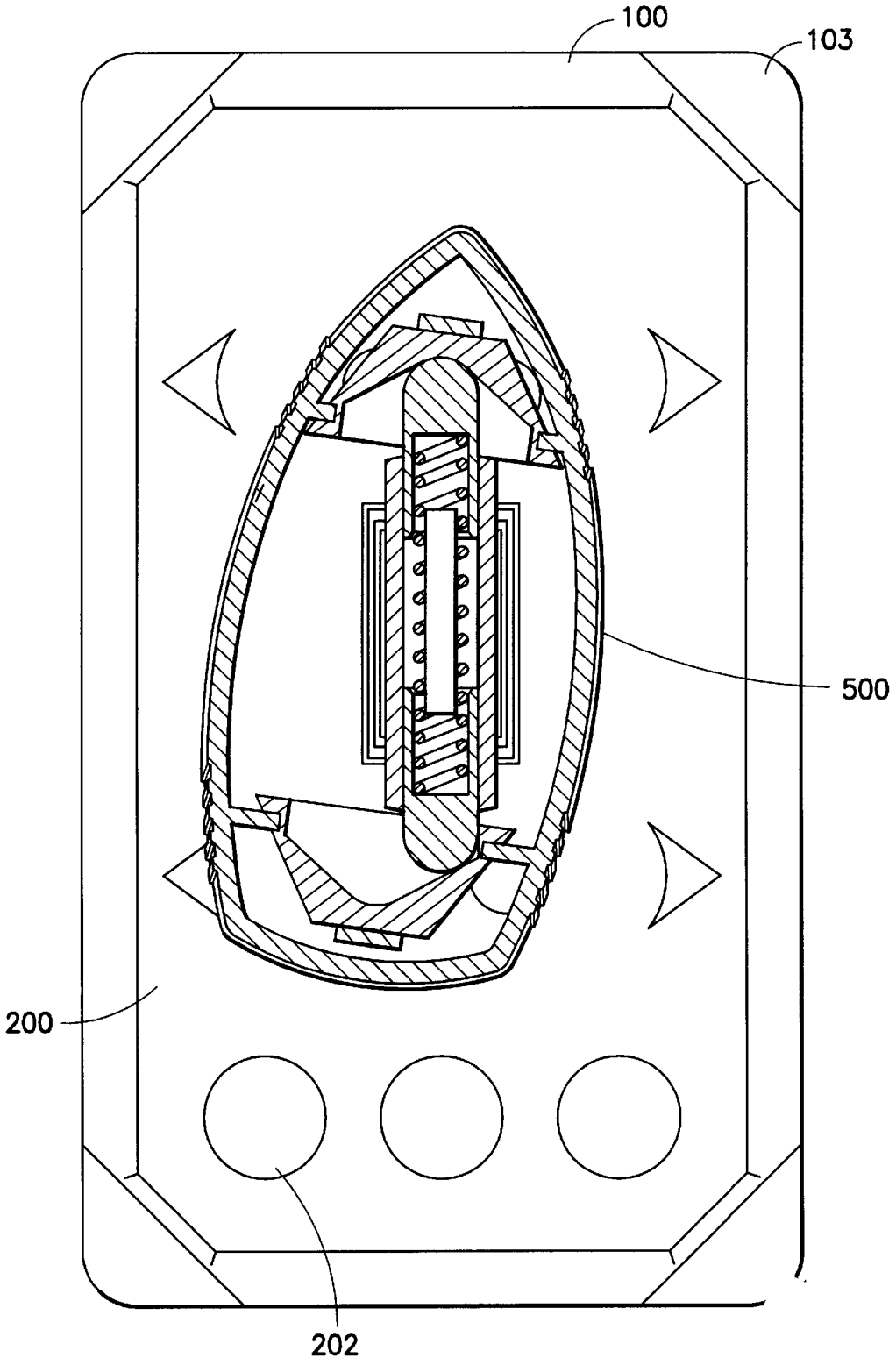
Figure 14:
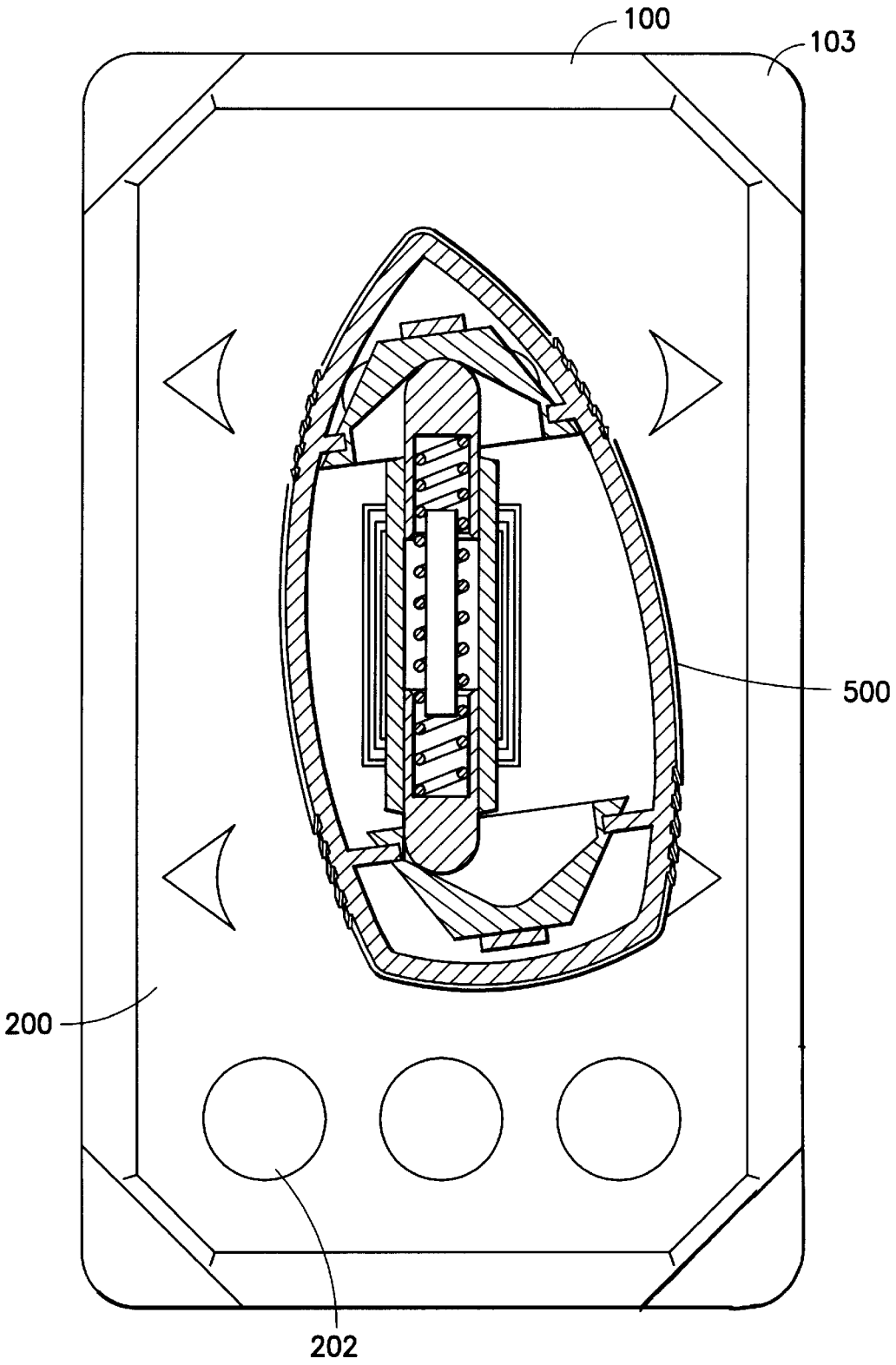
Figure 15:
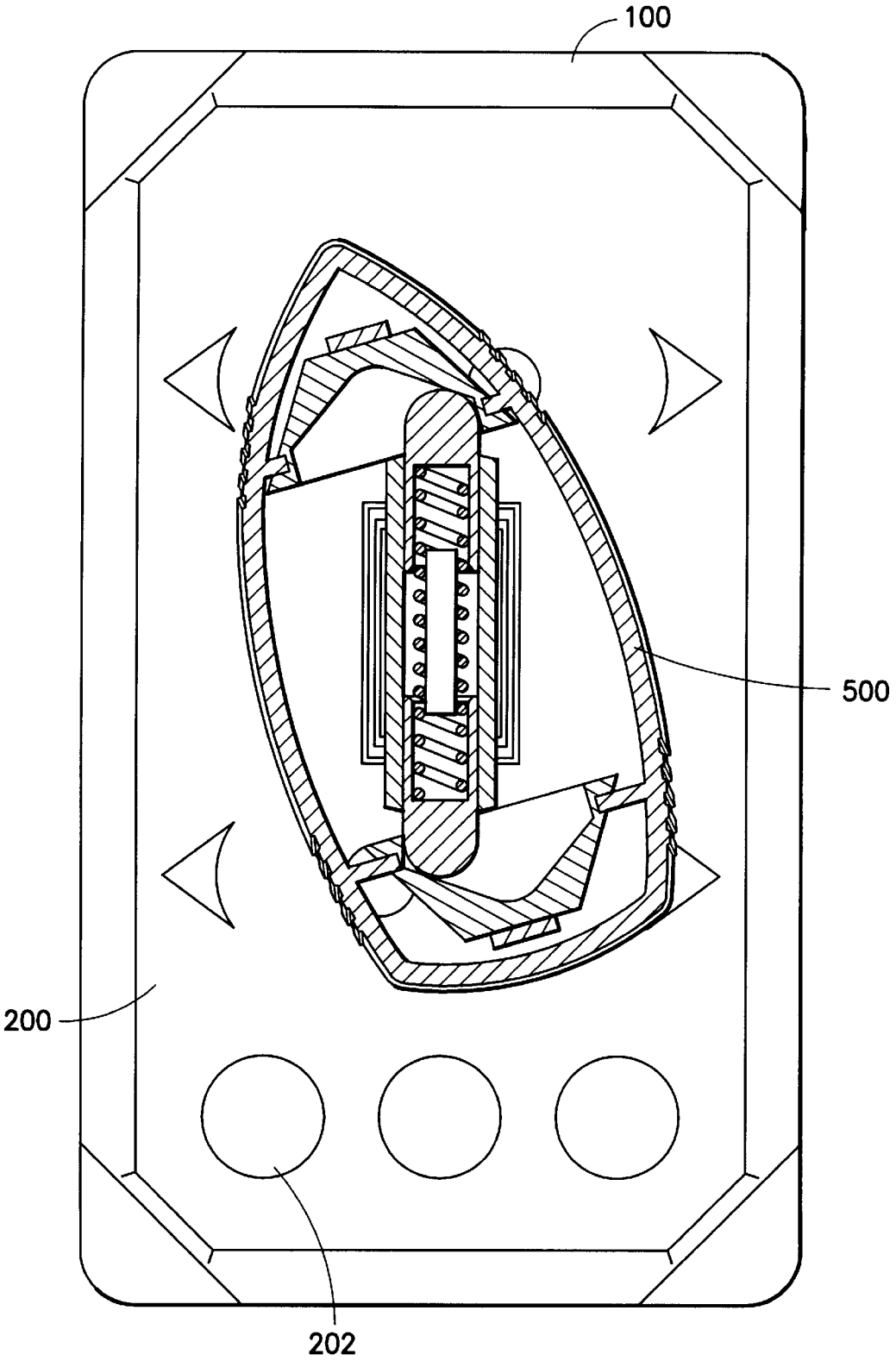
Figure 16:
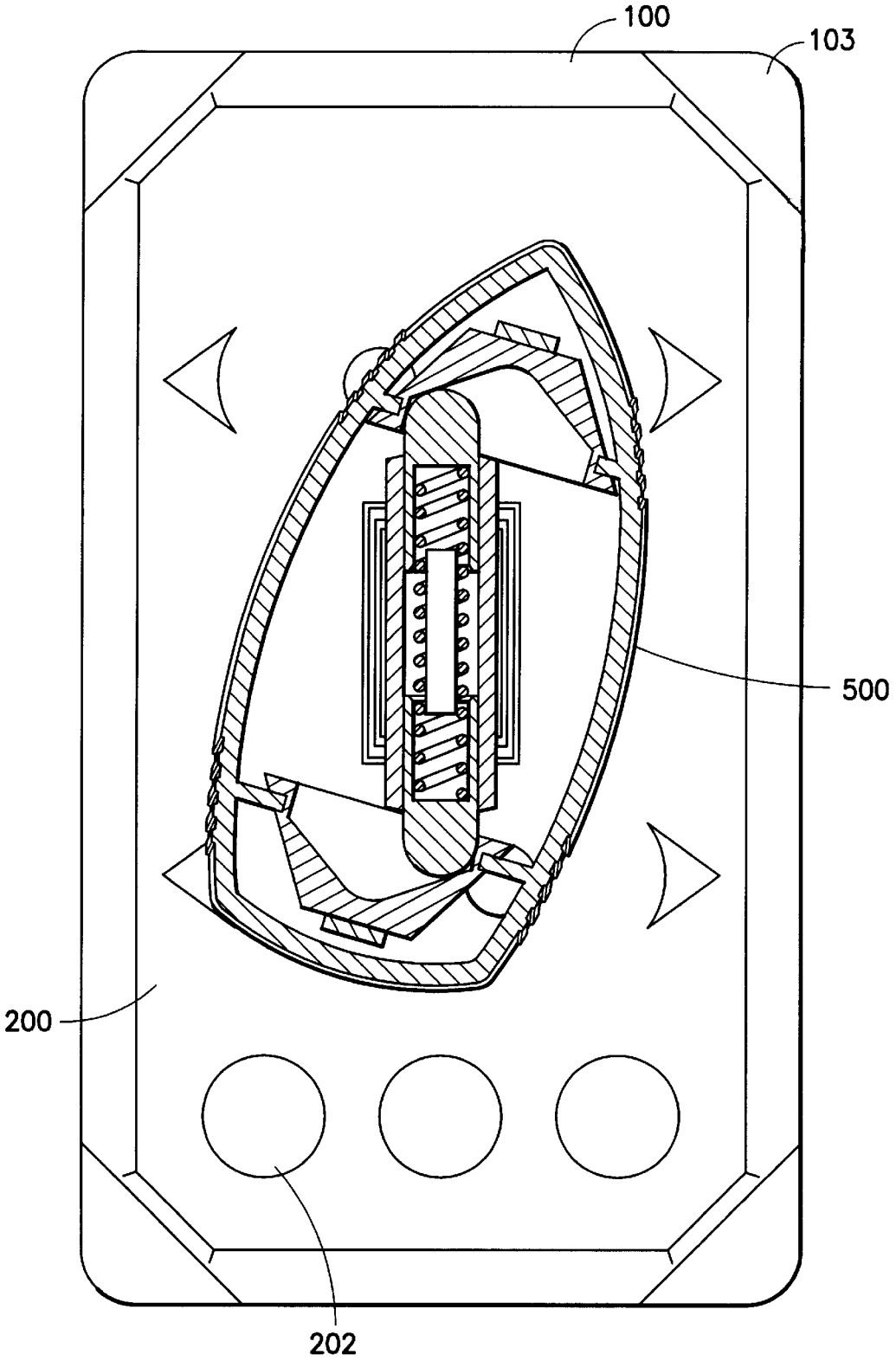
Figure 17:
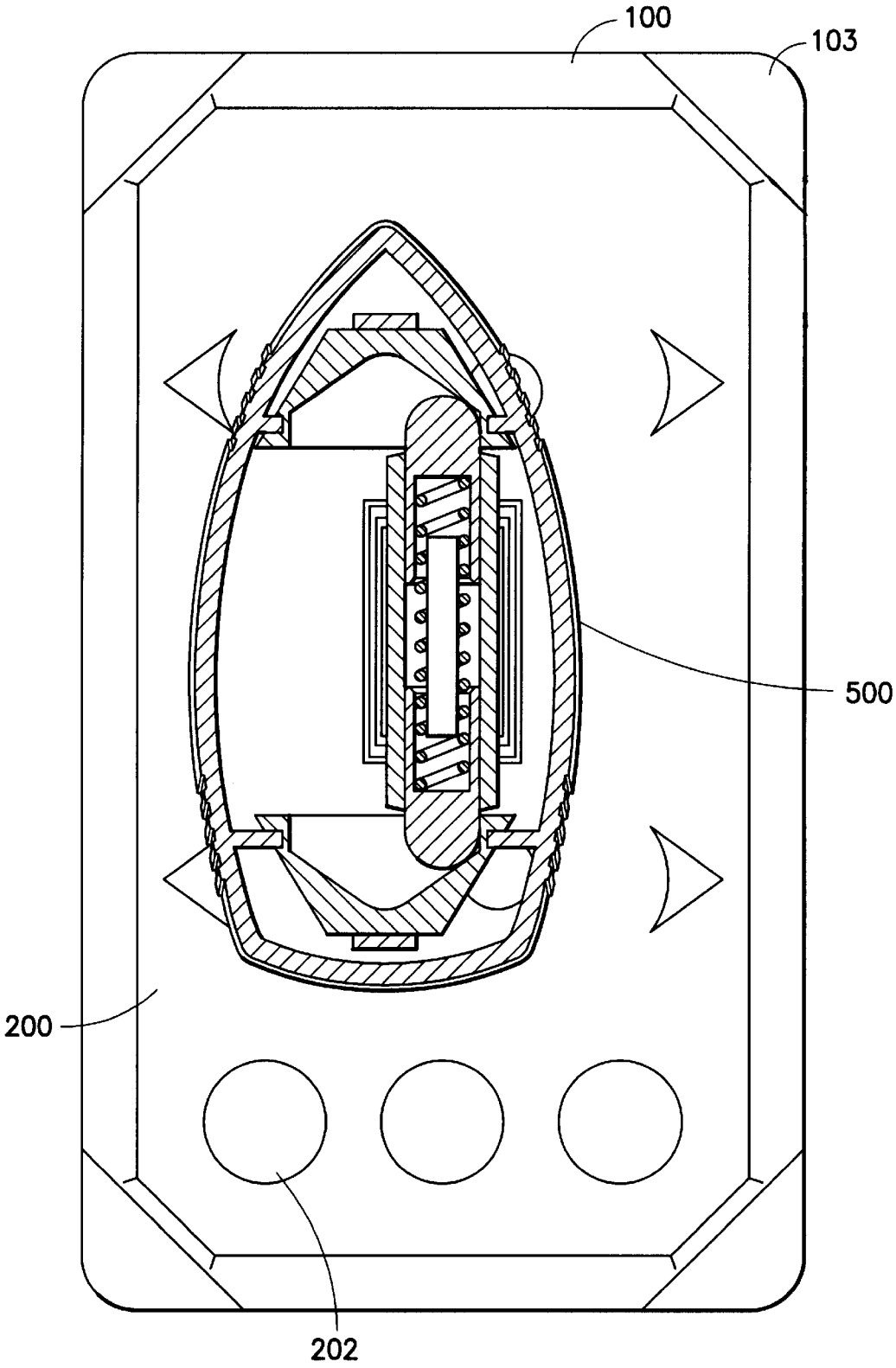
Figure 18:
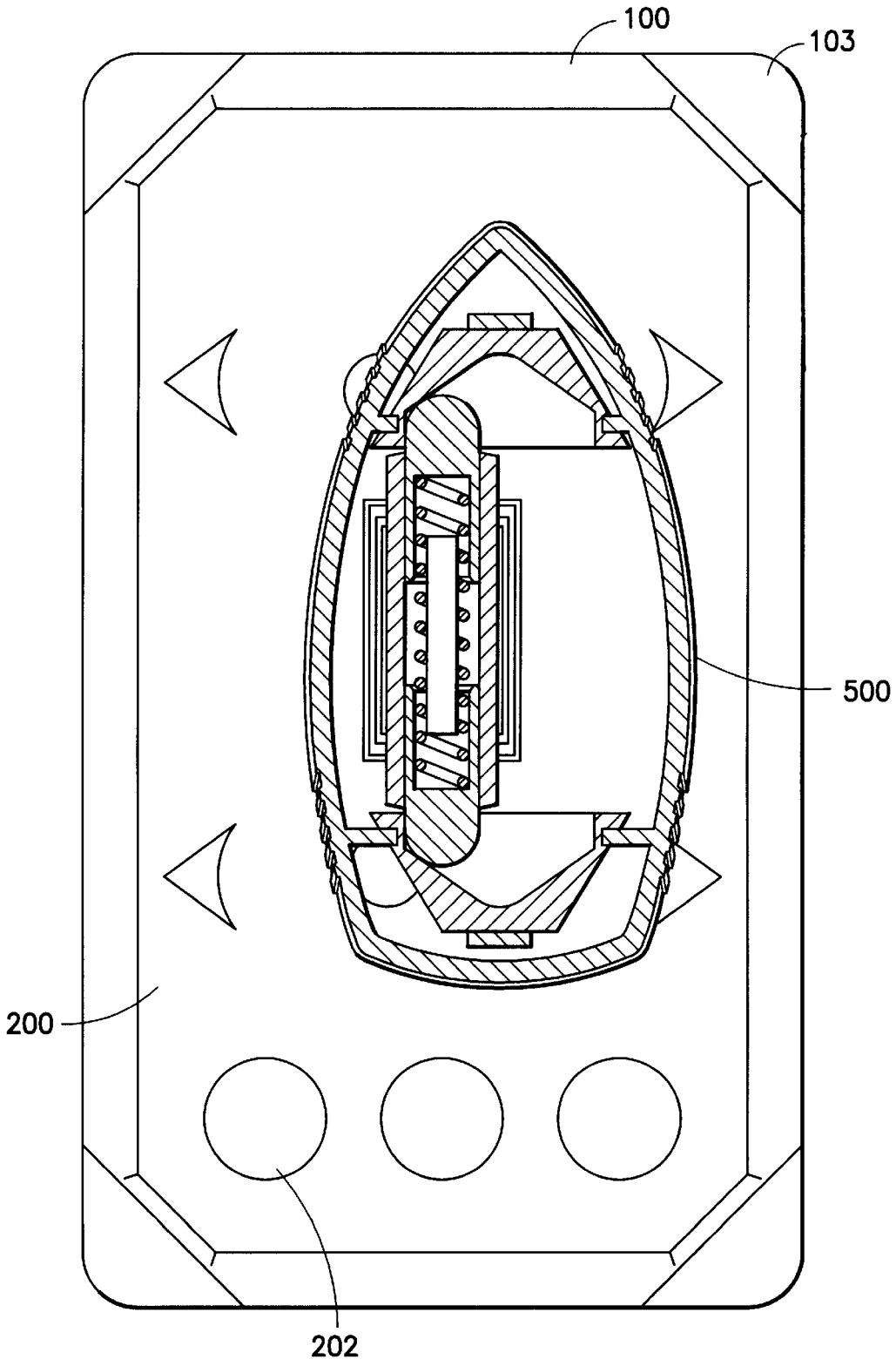

Referring to the FIGS. 1–18, the preferred embodiment of the control unit of the present invention comprises:

a base plate 100 with a socket 101, a lower housing 110, and a number of attachment screws 102 and fairings 103;

a switch panel 200 mounted on said base plate, where the switch panel has an opening 201 through which the plug extends, a number of optional on/off switches 202, and a number of embedded boat manoeuvring control switches 210; and a boat shaped, or navicular, control knob 500 mounted on the base plate such that it is displaceable over the switch panel.

The control knob is equipped with a number of pair s of forward and aft tongues 501, 502, forward and aft snap locks 503, 504, a number of stabilising knobs 505, and a number of corrugated or serrated fields 520 for providing a secure grip of the knob.

The control knob is generally mounted on the base plate by means of a plug 300 and a pair of forward and aft guide elements 400. The plug 300 has a longitudinal bore 301 for slidably receiving an optional guide pin 312 and a coil spring 310. The optional guide pin is coaxially located within the coil spring. The lower structure of the plug extends through the opening or aperture in the switch panel and is mounted in the socket. The pair of forward and aft guide elements 400 are mounted on the outer ends 311*a* of forward and aft plug pins 311.

The navicular control knob is mounted onto the pair of guide elements by means of the forward and aft snap locks engaging into respective ones of the forward and aft guide elements.

The knob is aligned and supported on the guide elements by means of the forward and aft tongues being received into respective pairs of grooves 401 on the forward and aft guide elements. The knob is horizontally aligned with the switch panel by means of a number of stabilising knobs symmetrically disposed along the control knob lower edge, and proximal with the upper surface of the panel.

The control knob and guide element assembly is movably attached to the plug by means of forward and aft plug pins 311 being longitudinally aligned with the plug. The plug pins have outer ends 311*a* each being movably received into respective ones of forward and aft guide element cavities 403, and the plug pins have inner bores 311*b* for receiving opposite ends of the coil spring and guide pin assembly, the plug pins, guide pin and spring being slidably disposed in the plug longitudinal bore.

Each guide element comprises a lower housing 402 coaxial with vertical axis $Z_1$, for slidably receiving a one of an actuator spring 420 and a one of an actuator peg 425, each said spring being interposed between each said lower housing inner face and each said peg upper end, and where each said actuator peg is in slidable contact with said switch panel.

The actuator springs exert respective downward acting forces on said respective actuator peg, and the downward acting force is transmitted to the switch panel.

In a non-actuated state, the navicular control knob remains in a neutral position in which position no one of said control switches are operated.

By transmitting said downward acting force, the forward and aft actuator pegs activate the forward and aft embedded boat manoeuvring control switches respectively in a manner corresponding with a selective displacement of said navicular control knob.

Any part of the navicular control knob is selectively rotably displaceable about a control knob vertical axis ($Z_2$), by selective application of a laterally directed force. Any part of the knob is selectively laterally displaceable by selective application of a laterally directed force.

Due to the guide element having said cavity with a cavity radius (k), said plug having a plug end radius (r), and said plug spring having a spring constant (K), the navicular control knob automatically returns to a said neutral position when said control knob is released. The cavity radius (k) is generally equal to a plug pin radius (t).

It is advantageous to have employ one plug spring extending through the plug bore, instead of two individual spring associated with each plug pin. One plug spring facilitates an easier transverse movement and contributes in a favourable manner to keeping one knob end stationary, when the other is being moved. Such movement of a first control knob end will compress the plug spring axially and thus increase the pressure of the plug pin at the second end, which in turn applies a pressure towards its associated guide element; contributing to keeping the second end in a stationary position.

The stabilising knobs symmetrically disposed along the control knob lower edge are proximal with the upper surface of said panel but do not come into contact with the boat manoeuvring control switches. The stabilising knobs prevent said control knob lower edge from engaging said switch panel and said embedded boat manoeuvring control switches.

The plug guides said plug pins in axially opposing longitudinal directions. The plug outer ends have respective radii (r) corresponding to one half the minimum distance between said guide element rear vertical surfaces 404. The navicular control knob is selectively rotable about a vertical axis ($Z_2$). The control knob is selectively rotable about a one of a pair of guide element vertical axes ($Z_1$). The knob is selectively laterally displaceable.

Each one of the embedded boat manoeuvring control switches is selectively individually slidably actuated by means of a respective one of said actuator peg. Each one of the embedded boat manoeuvring control switches is selectively individually actuated by means of selective manipulation of said navicular control knob. The navicular control knob longitudinal displacement when said control knob is rotated an angle (β), is limited by said radii (r) and said plug longitudinal dimension. The navicular control knob is axially fixed in a longitudinal direction when said control knob is in a non-actuated position. The navicular control knob is axially fixed in a longitudinal direction when said control knob is selectively laterally displaced.

Each one of said downward acting forces on said respective actuator peg is sufficient to retain a one of said actuator peg in a said neutral position when said other of said actuator peg is selectively laterally displaced.

In an alternative embodiment, the forward and aft guide elements are integral with the control knob.

In one alternative embodiment, the number of actuator pegs corresponds to the number of boat manoeuvring control switches.

In yet another embodiment of the invention, the panel boat manoeuvring control switches may comprise any number of switches.

In yet another embodiment of the present invention, the boat manoeuvring control switch means are a plurality of micro switches mounted on said panel.

In yet another embodiment of the present invention, the boat manoeuvring control switches are micro switches disposed inside each one of said guide element cavity, for actuation by said plug pins.

The control unit may also control the forward and aft motion of a boat 10. The control unit may also be a main propulsion control unit of said boat, if additional switches controlling the main propulsion systems, are added, internally or externally, to the control knob.

Bow and stern thrusters 11, 12 on a boat 10 may be controlled by means of the boat manoeuvring control unit in accordance with the invention, where the method comprises a selection of one or more of the following steps:

- displacing said navicular control knob forward part in a left hand direction to accomplish a bow thruster force inducing a port hand bow motion;
- displacing said navicular control knob forward part in a right hand direction to accomplish a bow thruster force inducing a starboard hand bow motion;
- displacing said navicular control knob aft part in a left hand direction to accomplish a stern thruster force inducing a port hand stern motion;
- displacing said navicular control knob aft part in a right hand direction to accomplish a stern thruster force inducing a starboard hand stern motion;
- displacing said navicular control knob forward part in a left hand direction and said navicular control knob aft part in a right hand direction to simultaneously accomplish respectively a bow thruster force inducing a port hand bow motion and a stern thruster force inducing a starboard hand stern motion;
- displacing said navicular control knob forward part in a right hand direction and said navicular control knob aft part in a left hand direction to simultaneously accomplish respectively a bow thruster force inducing a starboard hand bow motion and a stern thruster force inducing a port hand stem motion;
- laterally displacing said navicular control knob in a left hand direction to simultaneously accomplish a bow thruster force and a stem thruster force inducing a generally lateral port hand motion;

laterally displacing said navicular control knob in a right hand direction to simultaneously accomplish a bow thruster force and a stem thruster force inducing a generally lateral starboard hand motion.

Thus, the boat manoeuvring control unit in accordance with the invention may be used to control thrusters on a boat. Indeed, any boat propulsion unit may be controlled by the control unit according to the invention, e.g. any number of bow and stem thrusters, main and/or auxiliary propulsion units.

The invented control unit allows for a method for controlling a boat, employing not only conventional thrusters, but any number of a plurality of any other boat propulsion unit.

The boat manoeuvring control unit in accordance with accordance with the invention may be used for controlling any plurality of propulsion units on a boat. The boat manoeuvring control unit in accordance with accordance with the invention may be used for controlling the main of propulsion units on a boat.

The foregoing description and the embodiments of the present invention are to be construed as mere illustrations of the application of the principles of the invention. The foregoing is not intended to limit the scope of the claims, but the true spirit and scope of present invention is defined by the claims.

What is claimed is:

1. A boat manoeuvring control unit, comprising:

a base plate having a socket, a lower housing, and attachment means;

a switch panel mounted on said base plate, said switch panel having a plug receiving aperture, and a number of boat manoeuvring control switch means; and a navicular control knob mounted on said base plate and being displaceable over said panel, said control knob having a plurality of engagement means, said control knob having the general shape of a boat hull and being mounted on said base plate by:

a plug, having a longitudinal bore for slidably receiving a coil spring, said plug lower structure extending through said aperture and being mounted in said socket; and a pair of forward and aft guide elements mounted on the outer ends of forward and aft plug pins and engaging said engaging means respectively.

2. The boat manoeuvring control unit in accordance with claim 1, wherein said control knob further being mounted onto said pair of guide elements by said engagement means engaging into respective said forward and aft guide elements, and aligned and supported on said guide elements by said engagement means being received on said forward and aft guide elements.

3. The boat manoeuvring control unit in accordance with claim 1, wherein said control knob and guide element assembly is movably attached to said plug by forward and aft plug pins being longitudinally aligned with said plug and where said plug pins having outer ends each being movably received into respective ones of forward and aft guide element cavities, said plug pins having inner bores for receiving opposite ends of said coil spring, said plug pins and spring being slidably disposed in said plug longitudinal bore.

4. The boat manoeuvring control unit in accordance with claim 1, wherein said each said guide element comprises a lower housing coaxial with a vertical axis, for slidably receiving a one of an actuator spring and a one of an actuator peg, each said spring being interposed between each said lower housing inner face and each said peg upper end, and where each said actuator peg is proximal with said switch panel.

5. The boat manoeuvring control unit in accordance with claim 1, wherein said actuator springs exert respective downward acting forces on said respective actuator peg, and wherein said downward acting force is selectively transmitted to said switch.

6. The boat manoeuvring control unit in accordance with claim 1, wherein said navicular control knob in a non-actuated state remains in a neutral position in which position no one of said control switches are operated.

7. The boat manoeuvring control unit in accordance with claim 1, wherein said forward and aft actuator pegs by transmitting said downward acting force, activates said plurality of forward and aft boat manoeuvring control switches respectively in a manner corresponding with a selective displacement of said navicular control knob.

8. The boat manoeuvring control unit in accordance with claim 1, wherein any part of said navicular control knob is selectively rotatably displaceable about a control knob vertical axis, by selective application of a laterally directed force.

9. The boat manoeuvring control unit in accordance with claim 1, wherein any part of said navicular control knob is selectively laterally displaceable by selective application of a laterally directed force.

10. The boat manoeuvring control unit in accordance with claim 1, wherein said attachment means comprise any a number of attachment screws and fairings.

11. The boat manoeuvring control unit in accordance with claim 1, wherein said switch panel is a diaphragm touch switch panel.

12. The boat manoeuvring control unit in accordance with claim 1, wherein said boat manoeuvring control switch means are a plurality of embedded boat manoeuvring control switches.

13. The boat manoeuvring control unit in accordance with claim 1, wherein said boat manoeuvring control switch means are a plurality of micro switches mounted on said panel.

14. The boat manoeuvring control unit in accordance with claim 1, said engagement means comprising a plurality of pairs of forward, and aft tongues, and forward and aft snap locks.

15. The boat manoeuvring control unit in accordance with claim 1, wherein said navicular control knob comprises horizontal alignment features.

16. The boat manoeuvring control unit in accordance with claim 1, wherein said horizontal alignment features comprise a plurality of stabilising knobs symmetrically disposed along said control knob lower edge to be proximal with the upper surface of said panel.

17. The boat manoeuvring control unit in accordance with claim 1, wherein said navicular control knob comprises a number of serrated or corrugated fields.

18. The boat manoeuvring control unit in accordance with claim 1, wherein said navicular control knob, by said guide element having said cavity with a cavity radius, said plug having a plug end radius, and said plug spring having a spring constant, automatically returns to a said neutral position when said control knob is released.

19. The boat manoeuvring control unit in accordance with claim 1, wherein said cavity radius is generally equal to a plug pin radius.

20. The boat manoeuvring control unit in accordance with claim 1, wherein said stabilising knobs symmetrically disposed along said control knob lower edge are proximal with the upper surface of said panel but not with said embedded boat manoeuvring control switches.

21. The boat manoeuvring control unit in accordance with claim 1, wherein said stabilising knobs prevent said control knob lower edge from engaging said switch panel and said embedded boat manoeuvring control switches.

22. The boat manoeuvring control unit in accordance with claim 1, wherein said plug guides said plug pins in axially opposing longitudinal directions.

23. The boat manoeuvring control unit in accordance with claim 1, wherein said plug outer ends have respective radii corresponding to one half the minimum distance between said guide element rear vertical surfaces.

24. The boat manoeuvring control unit in accordance with claim 1, wherein said navicular control knob is selectively rotatable about a vertical axis.

25. The boat manoeuvring control unit in accordance with claim 1, wherein said navicular control knob is selectively rotatable about a one of a pair of guide element vertical axes.

26. The boat manoeuvring control unit in accordance with claim 1, wherein said navicular control knob is selectively laterally displaceable.

27. The boat manoeuvring control unit in accordance with claim 1, wherein each one of said embedded boat manoeuvring control switches is selectively individually slidably actuated by a respective one of said actuator peg.

28. The boat manoeuvring control unit in accordance with claim 1, wherein each one of said embedded boat manoeuvring control switches is selectively individually actuated by selective manipulation of said navicular control knob.

29. The boat manoeuvring control unit in accordance with claim 1, wherein said navicular control knob longitudinal displacement when said control knob is rotated an angle, is limited by said radii and said plug longitudinal dimension.

30. The boat manoeuvring control unit in accordance with claim 1, wherein said navicular control knob is axially fixed in a longitudinal direction when said control knob is in a non-actuated position.

31. The boat manoeuvring control unit in accordance with claim 1, wherein said navicular control knob is axially fixed in a longitudinal direction when said control knob is selectively laterally displaced.

32. The boat manoeuvring control unit in accordance with claim 1, wherein said each one of said downward acting forces on said respective actuator peg is sufficient to retain a one of said actuator peg in a said neutral position when said other of said actuator peg is selectively laterally displaced.

33. The boat manoeuvring control unit in accordance with claim 1, wherein said control unit controls the forward and aft motion of a boat.

34. The boat manoeuvring control unit in accordance with claim 1, wherein said control unit is a main propulsion control unit of said boat.

35. The boat manoeuvring control unit in accordance with claim 1, wherein said coil spring is longitudinally guided by a guide pin, said pin being coaxially located within said spring, and said plug longitudinal bore slidably receiving said guide pin and spring.

36. The boat manoeuvring control unit in accordance with claim 1, wherein said control unit employs one coil spring.

37. The boat manoeuvring control unit in accordance with claim 1, wherein said forward and aft guide elements are integral with said control knob.

38. The boat manoeuvring control unit in accordance with claim 1, wherein said switch panel comprise a plurality of on/off switches.

39. The boat manoeuvring control unit in accordance with claim 1, wherein said boat manoeuvring control switches are micro switches disposed inside each one of said guide element cavity, for actuation by said plug pins.

40. The boat manoeuvring control unit in accordance with claim 1, wherein said actuator pegs in number correspond to the number of boat manoeuvring control switches.

41. The boat manoeuvring control unit in accordance with claim 1, wherein said panel boat manoeuvring control switches are any number of switches.

42. The boat manoeuvring control unit in accordance with claim 1, wherein said control knob having the general shape of a boat hull.

43. A method for controlling bow and stern thrusters on a boat using a boat manoeuvring control unit having a navicular control knob, the method comprising a selection of one or more of the following steps:

displacing said navicular control knob forward part in a left hand direction to accomplish a bow thruster force inducing a port hand bow motion;

displacing said navicular control knob forward part in a right hand direction to accomplish a bow thruster force inducing a starboard hand bow motion;

displacing said navicular control knob aft part in a left hand direction to accomplish a stern thruster force inducing a port hand stern motion;

displacing said navicular control knob aft part in a right hand direction to accomplish a stern thruster force inducing a starboard hand stern motion;

displacing said navicular control knob forward part in a left hand direction and said navicular control knob aft part in a right hand direction to simultaneously accomplish respectively a bow thruster force inducing a port hand bow motion and a stern thruster force inducing a starboard hand stern motion;

displacing said navicular control knob forward part in a right hand direction and said navicular control knob aft part in a left hand direction to simultaneously accomplish respectively a bow thruster force inducing a starboard hand bow motion and a stern thruster force inducing a port hand stern motion;

laterally displacing said navicular control knob in a left hand direction to simultaneously accomplish a bow thruster force and a stern thruster force inducing a generally lateral port hand motion;

laterally displacing said navicular control knob in a right hand direction to simultaneously accomplish a bow thruster force and a stern thruster force inducing a generally lateral starboard hand motion;

wherein said boat manoeuvring control unit comprises:

a base plate having a socket, a lower housing, and attachment means;

a switch panel mounted on said base plate, said switch panel having a plug receiving aperture, and a number of boat manoeuvring control switch means; and said navicular control knob mounted on said base plate and being displaceable over said panel, said control knob having a plurality of engagement means, said control knob having the general shape of a boat hull and being mounted on said base plate by:

a plug, having a longitudinal bore for slidably receiving a coil spring, said plug lower structure extending through said aperture and being mounted in said socket; and a pair of forward and aft guide elements mounted on the outer ends of forward and aft plug pins and engaging said engaging means respectively.

44. The method in accordance with claim 43, wherein said bow thruster force and stern thruster force individually or separately may be any number of a plurality of forces generated by any one of a plurality of any other boat propulsion unit.

* * * * *